US006357948B1

(12) United States Patent
Jung et al.

(10) Patent No.: US 6,357,948 B1
(45) Date of Patent: Mar. 19, 2002

(54) INK TRANSMITTING SYSTEM FOR LIQUID-BASED WRITING DEVICE

(76) Inventors: Jin H. Jung; Chang H. Jung, both of 75-6 Hyomok-dong, Dong-gu, Taegu, 701-030 (KR)

( * ) Notice: Subject to any disclaimer, the term of this patent is extended or adjusted under 35 U.S.C. 154(b) by 0 days.

(21) Appl. No.: 09/788,021

(22) Filed: Feb. 20, 2001

(51) Int. Cl.[7] ..... B43K 7/10
(52) U.S. Cl. ..... 401/216; 401/212; 401/214
(58) Field of Search ..... 401/209–217

(56) References Cited

U.S. PATENT DOCUMENTS 538,492 A * 4/1895 Askew ..... 401/212
2,208,588 A * 7/1940 LaForest ..... 401/212
5,957,609 A * 9/1999 Morita et al. ..... 401/214

* cited by examiner

*Primary Examiner*—Gregory L. Huson
*Assistant Examiner*—Peter deVore
(74) *Attorney, Agent, or Firm*—John K. Park; Park & Sutton LLP

(57) ABSTRACT

An ink transmitting system for a liquid-based writing tool comprises an ink storage whose upper end includes a mounting portion having a female screw with a relatively small radius, an opening formed through a central surface of a lower surface of the storage, an ink transfer body insertedly sealed through the mounting portion and the opening, a male screw formed on a mid periphery of the body and engaged on the female screw, balls rollingly provided within the ink transfer body in a linear alignment to continuously transfer the ink, an ink transfer roller rollingly provided between two balls adjacent to the ball support to surface-abut on the two balls, a base support insertedly disposed in another end of the ink transfer body, an elastic member supporting the base support, and an elastic support suppressing the elastic member, the elastic support sealingly connected to the other end of the body.

2 Claims, 3 Drawing Sheets

INK TRANSMITTING SYSTEM FOR LIQUID-BASED WRITING DEVICE

BACKGROUND OF THE INVENTION

The invention relates to a liquid-based writing device storing ink therein, such as a rollerball pointed pen or a felt tipped pen. More particularly, the present invention relates to an ink transmitting system for a liquid-based writing device which allows the ink therein to continuously flow to the device tip, thereby enabling a user to easily write even with a pen tip facing upward.

In general, liquid-based writing tools denote rollerball pointed pens or felt tipped pens utilizing liquid having flowability and viscosity that allow a user to keep writing on a paper sheet.

So liquid-based writing tools according to the prior art has a structure in which an ink transmitter is stored in a pen body. A tip of the ink transmitter storing ink therein comes in contact with a paper sheet when writing and accordingly the ink continuously flows from the ink transmitter through the tip onto the paper sheet.

For example, a conventional rollerball pointed pen has an ink cartridge disposed within the pen body, and the ink cartridge containing ink includes a ball support which enables a rollerball in the tip to self-rotate. In this construction, the rollerball of the ink cartridge delivers the ink onto the paper sheet while abutting to the paper sheet.

However, such a conventional ink transmitter has a disadvantage in that since a single ball is disposed at the tip of the ink cartridge the ink tends to flow down in the ink cartridge by its self-weight when writing with the pen facing upward, thereby causing a substantial inconvenience for a user to write in a position where the pen tip should face up.

SUMMARY OF THE INVENTION

The present invention is contrived to overcome the conventional disadvantages. Therefore, it is an object of the invention is to provide an ink transmitting system for a liquid-based writing device which allows the ink therein to continuously flow to the device tip without interruption, thereby enabling a user to easily write even with a pen tip facing upward.

To achieve the above-described object, the ink transmitting system for a liquid-based writing tool such as a rollerball pointed pen which allows the ink therein to continuously apply on an external paper sheet according to the present invention, comprising: an ink storage for storing an ink therein, wherein an upper end of the ink storage includes a mounting portion having a female screw portion with a relatively small radius, wherein an opening is formed through a central surface of a lower surface of the ink storage; an ink transfer body insertedly sealed through the mounting portion and the opening of the ink storage, wherein a male screw portion is formed on a mid periphery of the ink transfer body and engaged on the female screw portion of the ink storage, wherein a ball support is provided in an end portion of the ink transfer body, wherein a plurality of ink inhale holes are formed between the male screw portion and the ball support of the ink transfer body; a plurality of balls rollingly provided within the ink transfer body in a linear alignment to continuously transfer the ink; an ink transfer roller rollingly provided between two balls adjacent to the ball support among the balls to surface-abut on the two balls; a base support insertedly disposed in another end of the ink transfer body opposing the ball support; an elastic member elastically supporting the base support; and an elastic support suppressing and supporting the elastic member, wherein the elastic support is sealingly connected to the other end of the ink transfer body.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

With reference to the accompanying drawings, the present invention will now be described.

Figure 1:
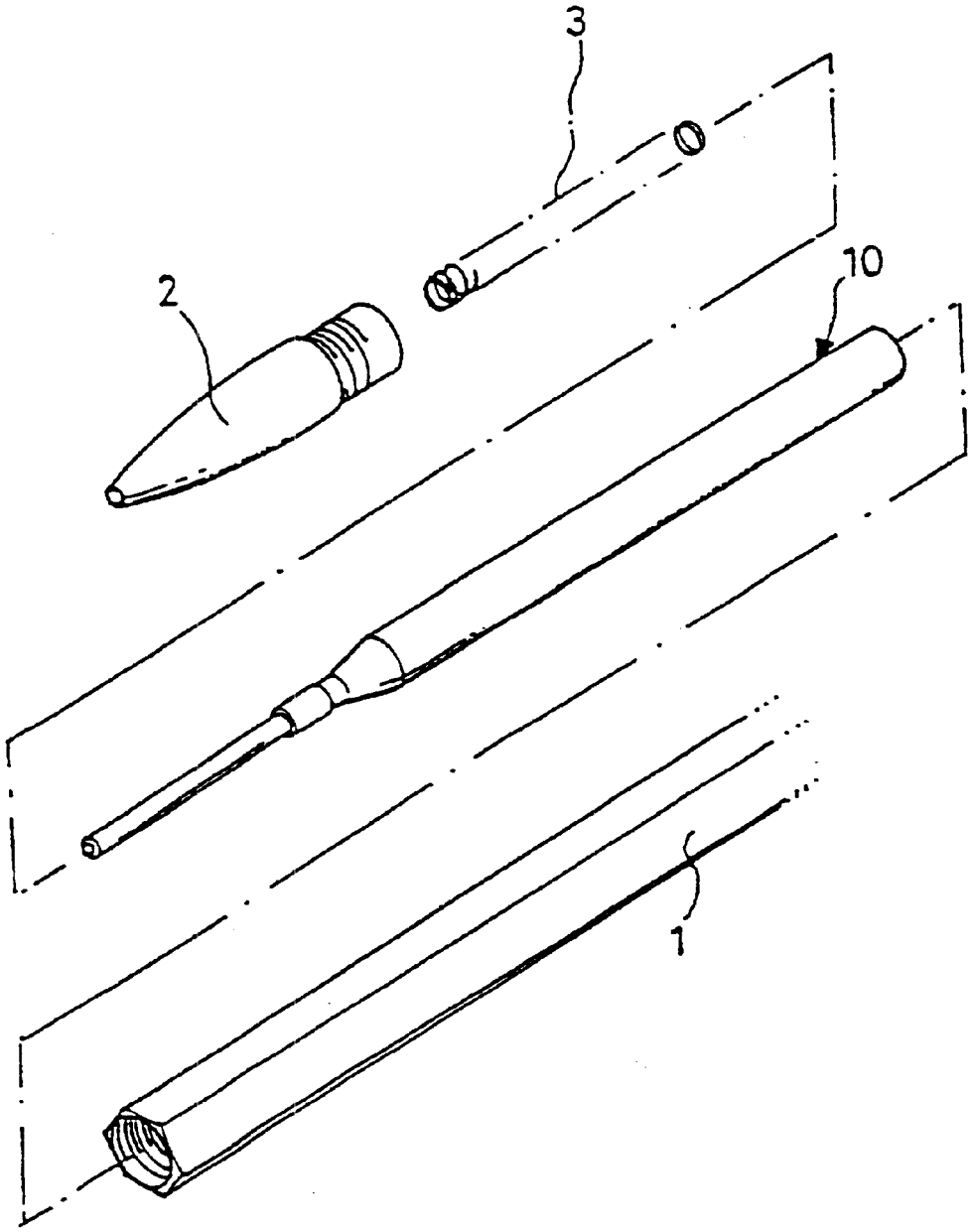
FIG. 1 is an exploded view showing a liquid-based writing device applicable to an ink transmitting system according to the present invention.
Figure 2:
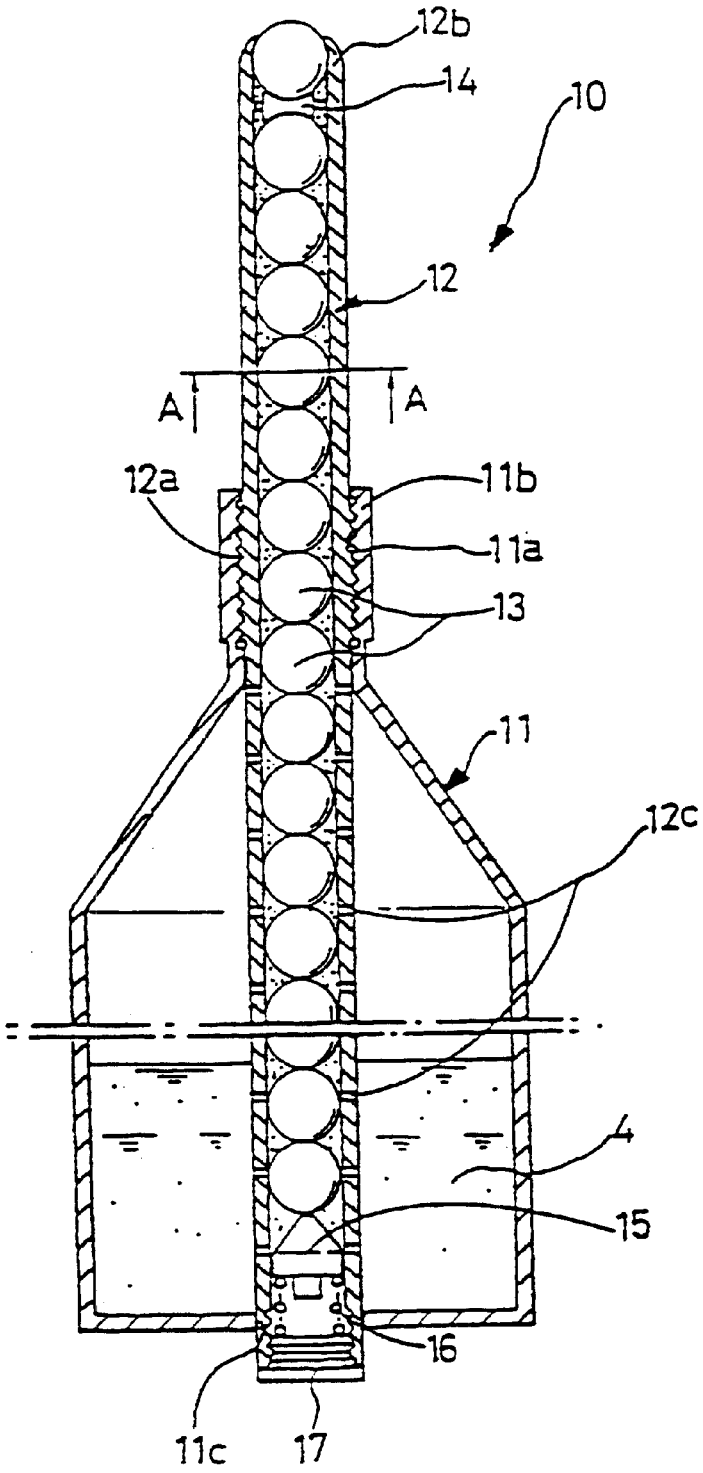
FIG. 2 is a cross-sectional view showing the ink transmitting system according to the present invention.
Figure 3:
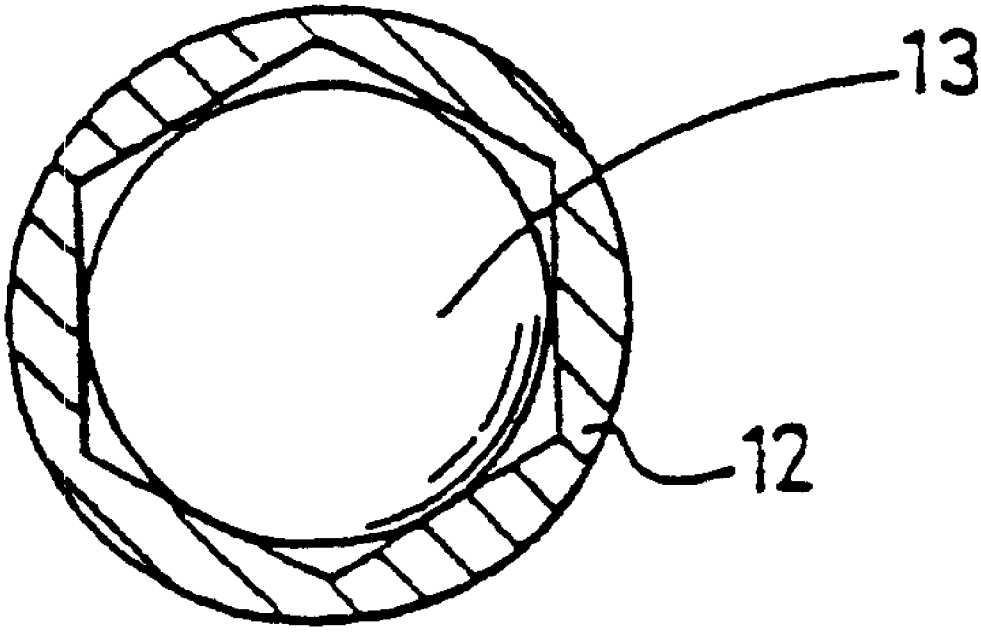
FIG. 3 is a cross-sectional view taken along line A—A in FIG. 2.

FIGS. 1 and 2 are views to explain the ink transmitting system for a liquid-based writing device according to the present invention, wherein the liquid-based writing device can be a rollerball pointed pen that allows a user to continue writing without interruption on a writing target such as a paper sheet. An embodiment of the present invention will exemplify a rollerball pointed pen among various liquid-based writing tools.

That is, a rollerball pointed pen includes an ink cartridge 10 in a casing 1 thereof. A base cover 2 is disposed at an end portion of the casing 1 so that the ink cartridge 10 is partially extruded through the base cover 2 which is also elastically supported by an elastic member 3 disposed in the base cover 2.

As shown in FIG. 2, an ink transfer body 12 is insertedly disposed through an ink storage 11. A plurality of balls 13 are provided within an interior of the ink transfer body 12. An ink transfer roller 14 is disposed between the uppermost two balls among the plurality of balls 13. A ball support 15 is disposed at the lower end of the ink transfer body 12 to support the lowermost one of the balls 13. An elastic member 16 is inserted in the ink transfer body 12. A support 17 is provided to seal the lower end of the ink transfer body 12.

The ink storage 11 includes a mounting portion 11*b* with a female screw 11*a*. An opening 11*c* is formed through the center portion of the lower surface of the ink storage 11 so that the ink storage 11 contains the ink 4 therein. The mounting portion 11*b* has a relatively short radius.

The ink transfer body 12 is bondingly sealed at the mounting portion 11*b* and the opening 11*c* of the ink storage 11. A male screw 12*a* is formed on a mid portion of the ink transfer body 12. Also, a ball support 12*b* is formed at the upper end in the drawing of FIG. 2. The ball support 12*b* is disposed above the male screw 12*a*. A plurality of ink inhale holes 12*c* are formed through a lower portion of the ink transfer body 12 and below the male screw 12*a*, wherein the ink inhale holes 12*c* are formed within the ink storage 11 that contains the ink 4.

The balls 13 are rotatably disposed in a linear alignment within the ink transfer body 12 so that the rotation of the balls 13 enable a continuous ink transmission.

The ink transfer roller 14 is provided between the uppermost ball and its adjacent ball of the balls 13 within the ink transfer body 12, wherein the uppermost ball is supported by the ball support 12*b*. In this construction, the roller 14 abuts to both the uppermost ball and its adjacent ball, thereby allowing the ink 4 to smoothly flow out in accordance with the rotation of the balls 13.

The ball support 15 is insertedly disposed in a lower portion of the ink transfer body 12 while opposing the ball support 12*b* so as to support the balls 13 to rotate. The elastic member 16 elastically supports the ball support 15. The elastic support 17 sustains the elastic member with pressure so that the elastic support 17 serves to seal and bond the lower portion of the ink transfer body 12 in the drawing of FIG. 2.

When the cross-sectioned interior of the ink transfer body 12 is formed circular a transfer path of the ink 4 becomes blocked by the balls 13. Therefore, the cross-sectioned interior of the ink transfer body 12 is preferably formed in hexagon and octagon to facilitate the rotation of the balls 13 while minimizing a spatial allowance for the passage of the ink 4.

The thusly constituted liquid-based ink transmitting system will be explained with an example of a rollerball pointed pen.

The ink cartridge 10 is inserted in the pen casing 1 and the elastic member 3 is carried on the end portion of the ink cartridge 10. The base cover 2 is engaged to the pen casing 1 for the pen assembly so that the ball support 12*b* of the ink transfer body 12 becomes extruded through the end portion of the base cover 2.

The assembled pen is held by a user and the ball 13 at the ball support 12*b* of the ink transfer body 12 abuts to a target paper sheet to enable a writing on the paper sheet.

Then, the uppermost end ball of the balls 13 abuts to the paper sheet while rotating. Accordingly, the ink transfer roller 14 rotates, whereby the plurality of balls 13 become engaged to the rotation of the ink transfer roller 14.

According to the rotation of the plurality of balls 13, the ink 4 continues to flow so that the ink 4 is transferred toward the ball support 12*b* of the ink transfer body 12 without interruption. The uppermost ball of the balls 13 makes a surface contact with the ink transfer roller 14 so that the rotation of the ink transfer roller 14 urges the ink 4 to more actively flow on the uppermost ball.

Therefore, even when writing on a paper sheet in a posture facing toward a ceiling, the user can easily write letters on the paper sheet.

Since the plurality of balls 13 are each provided to substantially block a cross-sectional inner space of the ink transfer body 12, the margin for ink transfer within the cross-sectional inner space of the ink transfer body 12 becomes sufficiently small to generate a capillary effect, whereby the lowering-of the ink 4 is prevented while the ink 4 flows more smoothly. Accordingly, the ink transmitting system according to the present invention enables its user to easily write regardless of his/her postures.

As discussed above, the ink transmitting system for a liquid-based writing tool allows a plurality of balls to abut to each other within the ink transfer body so as to continuously transfer the-ink toward the end portion of the ink transfer body, thereby enabling a user to easily write with a posture facing toward a ceiling, that is, either when the end portion of the ink transfer body faces up or when the user writes lying on his/her back, regardless of the user's writing posture.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. An ink transmitting system for a liquid-based writing tool such as a rollerball pointed pen which allows the ink therein to continuously apply on an external paper sheet, comprising:

an ink storage for storing an ink therein, wherein an upper end of the ink storage includes a mounting portion having a female screw portion with a relatively small radius, wherein an opening is formed through a central surface of a lower surface of the ink storage;

an ink transfer body insertedly sealed through the mounting portion and the opening of the ink storage, wherein a male screw portion is formed on a mid periphery of the ink transfer body and engaged on the female screw portion of the ink storage, wherein a ball support is provided in an end portion of the ink transfer body, wherein a plurality of ink inhale holes are formed between the male screw portion and the ball support of the ink transfer body;

a plurality of balls rollingly provided within the ink transfer body in a linear alignment to continuously transfer the ink;

an ink transfer roller rollingly provided between two balls adjacent to the ball support among the balls to surface-abut on the two balls;

a base support insertedly disposed in another end of the ink transfer body opposing the ball support;

an elastic member elastically supporting the base support; and an elastic support suppressing and supporting the elastic member, wherein the elastic support is sealingly connected to the other end of the ink transfer body.

2. The ink transmitting system of claim 1 wherein a cross-sectional inner space of the ink transfer body is formed either in hexagon or in octagon.

* * * * *